US007245281B2

(12) United States Patent
Sekido et al.

(10) Patent No.: US 7,245,281 B2
(45) Date of Patent: Jul. 17, 2007

(54) DRIVE CIRCUIT DEVICE FOR DISPLAY DEVICE, AND DISPLAY DEVICE USING THE SAME

(75) Inventors: Satoshi Sekido, Kawasaki (JP); Yasutake Furukoshi, Kawasaki (JP); Syouichi Fukutoku, Kawasaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 64 days.

(21) Appl. No.: 10/102,264

(22) Filed: Mar. 20, 2002

(65) Prior Publication Data

US 2003/0048249 A1 Mar. 13, 2003

(30) Foreign Application Priority Data

Sep. 12, 2001 (JP) ..... 2001-276090

(51) Int. Cl.
*G09G 3/36* (2006.01)

(52) U.S. Cl. ..... 345/87; 345/89; 345/92; 345/98; 345/100

(58) Field of Classification Search ..... 345/87, 345/89–98, 145, 100, 180, 197, 198, 55, 345/90, 92, 93, 204, 209, 210, 213, 8, 551, 345/520, 179, 174; 395/157; 370/447; 348/731, 671; 365/233, 194, 193; 326/56, 326/21; 711/154, 167

See application file for complete search history.

(56) References Cited

U.S. PATENT DOCUMENTS 3,906,203 A * 9/1975 Butulis ..... 235/437
4,654,695 A * 3/1987 Fling ..... 348/671
4,755,814 A * 7/1988 Olsen ..... 345/551
4,931,965 A * 6/1990 Kaneko et al. ..... 345/174
5,146,592 A * 9/1992 Pfeiffer et al. ..... 715/807
5,404,161 A * 4/1995 Douglass et al. ..... 725/15
5,414,443 A * 5/1995 Kanatani et al. ..... 345/95
5,510,859 A * 4/1996 Douglass et al. ..... 348/731
5,557,301 A * 9/1996 D'Aviau de Piolant ..... 345/179
5,801,673 A * 9/1998 Shimada et al. ..... 345/100
6,072,421 A * 6/2000 Fukae et al. ..... 342/42
6,072,445 A * 6/2000 Spitzer et al. ..... 345/8

(Continued)

FOREIGN PATENT DOCUMENTS

JP 5-188390 7/1993

(Continued)

*Primary Examiner*—Bipin Shalwala
*Assistant Examiner*—Prabodh Dharia
(74) *Attorney, Agent, or Firm*—Greer, Burns, & Crain, Ltd.

(57) ABSTRACT

A drive circuit device for a display device which drives a plurality of source bus lines provided on a display panel includes a driver unit that receives a clock signal, a data signal and a control signal, sequentially fetches the data signal, and generates drive signals for the source bus lines in accordance to the fetched data signal. The device further includes a gate unit that, after elapse of specified time from the reception of the driver unit, and at a timing when a rear-stage drive circuit device starts receiving, starts outputting of a propagation signal including at least one of the clock signal, data signal and control signal to the rear-stage drive circuit device. Consequently, the power consumption required for supplying these signals and the generated amount of electromagnetic waves resulting from the signal supply can be suppressed.

17 Claims, 8 Drawing Sheets

U.S. PATENT DOCUMENTS

| | | | | |
|---|---|---|---|---|
| 6,118,461 | A * | 9/2000 | Taylor | 345/520 |
| 6,292,412 | B1 * | 9/2001 | Kato et al. | 365/194 |
| 6,328,648 | B1 * | 12/2001 | Walker et al. | 463/20 |
| 6,346,828 | B1 * | 2/2002 | Rosen et al. | 326/56 |
| 6,417,827 | B1 * | 7/2002 | Nagao et al. | 345/89 |
| 6,563,481 | B1 * | 5/2003 | Watanabe et al. | 345/87 |
| 6,625,702 | B2 * | 9/2003 | Rentschler et al. | 711/154 |
| 6,697,040 | B2 | 2/2004 | Imajo et al. | |
| 6,735,217 | B1 * | 5/2004 | Webber et al. | 370/447 |
| 6,741,229 | B1 * | 5/2004 | Yanagi et al. | 345/98 |
| 6,839,046 | B1 | 1/2005 | Orisaka et al. | |
| 6,842,399 | B2 * | 1/2005 | Harrison | 365/233 |
| 6,965,365 | B2 * | 11/2005 | Nakamura | 345/87 |
| 6,985,004 | B2 * | 1/2006 | Cohn et al. | 326/21 |
| 2001/0054997 | A1 * | 12/2001 | Fujioka et al. | 345/87 |
| 2002/0075211 | A1 * | 6/2002 | Nakamura | 345/87 |
| 2002/0145582 | A1 * | 10/2002 | Yamazaki et al. | 345/92 |
| 2002/0147896 | A1 * | 10/2002 | Rentschler et al. | 711/167 |
| 2002/0172079 | A1 * | 11/2002 | Hargis et al. | 365/193 |
| 2003/0025660 | A1 * | 2/2003 | Miyazawa et al. | 345/87 |
| 2003/0179158 | A1 * | 9/2003 | Sakaki | 345/55 |
| 2004/0046727 | A1 * | 3/2004 | Fujioka et al. | 345/98 |
| 2006/0007208 | A1 * | 1/2006 | Aoki | 345/204 |
| 2006/0061532 | A1 * | 3/2006 | Hashimoto | 345/89 |

FOREIGN PATENT DOCUMENTS

| | | |
|---|---|---|
| JP | 7-049657 | 2/1995 |
| JP | 2000-227783 | 8/2000 |
| KR | 2000-0048158 | 7/2000 |
| KR | 2001-0082742 | 8/2001 |

* cited by examiner

DRIVE CIRCUIT DEVICE FOR DISPLAY DEVICE, AND DISPLAY DEVICE USING THE SAME

BACKGROUND OF THE INVENTION

1. Field of the Invention

The present invention relates generally to a drive circuit device for a display device such as a liquid crystal display device, and more particularly, to a drive circuit device that can reduce power consumption and suppress occurrence of electromagnetic waves.

2. Description of the Related Art

The liquid crystal display device is now widely being used for the monitor screen of a computer, etc., because of its space-saving feature. In recent years, a larger type is further being called for, and development of structure to meet the requirement is increasingly being made.

Of the liquid crystal display devices, a liquid crystal display device of an active-matrix type has pixels in a matrix arrangement, using active elements, like TFTs (thin film transistors). This liquid crystal display device has pixel electrodes and a common electrode on a liquid crystal display panel or substrate, and a liquid crystal layer between them. Further, the liquid crystal display panel has source bus lines and gate bus lines, which cross each other, and TFTs provided at the crossing positions. And, by driving the gate bus lines to cause the TFTs of the pixels located in the row direction to a conductive state, and applying voltage corresponding to the half tone of the pixel to each source bus line, the voltage corresponding to the half tone of the pixel is applied between the pixel electrode and the common electrode. As the result of the application of voltage, the liquid crystal layer between the pixel electrode and the common electrode has a transmission factor corresponding to the applied voltage, thereby allowing a reproduction of an expected half tone to be possible.

In order to perform such display operations, a gate driver which sequentially drives the gate bus lines, and a source driver which drives the source bus lines simultaneously with the voltage corresponding to the displayed data, are connected to the liquid crystal display panel. The gate driver and the source driver will be embodied by an integrated circuit device, and each of the drivers drives a plurality of gate bus lines or a plurality of source bus lines, respectively. Therefore, in order to drive many gate bus lines and the source bus lines on the display circuit board, a plurality of the gate drivers and source drivers must be connected to the area around the liquid crystal display panel.

With the requirement for space saving, the downsizing of the liquid crystal display device seems to be the current trend, but, on the other hand, to meet the request for larger size of the monitor screen, a space for packing the gate driver and the source driver is becoming limited. With this limitation, signal lines for the data signal, clock signal or control signal to be supplied to the plurality of the source drivers and the gate drivers are formed on an LCD panel, on which TFT source bus lines and gate bus lines for the liquid crystal display panel are installed.

Unlike a printed circuit board, the signal lines to be formed on the liquid crystal display panel has relatively higher resistance and capacitance compared with a printed circuit board, and cannot be covered with a ground wiring layer. For this reason, when pulse signal with high frequency is applied to these signal lines, a lot of power is consumed to drive these signal lines, and a strong electromagnetic wave will be sent out along with the driving. Especially, along the upsizing of the screen, the number of the driver Ics will be increased, and further, the signal lines for propagating the data signal, clock signal, or control signal becomes longer, so that the power consumption and occurrence of electromagnetic wave is considerably increased.

SUMMARY OF THE INVENTION

It is therefore the object of the present invention to provide a drive circuit device for a display device that can suppress power consumption and occurrence of electromagnetic waves, and a display device using the same.

In order to attain the above objects, an aspect of the present invention provides a drive circuit device for a display device which drives a plurality of source bus lines provided on a display panel, the drive circuit device comprising: a driver unit that receives a clock signal, a data signal and a control signal, and sequentially fetches the data signal, and generates drive signals for the source bus lines in accordance to the fetched data signal; and a gate unit that, after elapse of specified time from the reception of the driver unit, and at a timing when a rear-stage drive circuit device starts receiving, starts outputting of a propagation signal including at least one of the clock signal, data signal and control signal to the rear-stage drive circuit device.

In order to achieve the above objects, another aspect of the present invention provides a drive circuit device for a display device which sequentially drives a plurality of gate bus lines provided on a display panel, the drive circuit device comprising: a driver unit that receives a clock signal and a control signal, and sequentially generates a drive signal for the gate bus lines, in synchronism with the clock signal; and a gate unit that, after elapse of specified time from the reception of the driver unit, and at a timing when a rear-stage drive circuit device starts receiving, starts outputting of a propagation signal including at least one of the clock signal and control signal to the rear-stage drive circuit device.

According to the present invention, a drive circuit device on a front stage receives the clock signal, data signal and control signal for generating the drive signal, and output at least one signal of these signals at a timing when a drive circuit device on a rear stage starts receiving these signals. Therefore, when a plurality of drive circuit devices are provided in serial on a display panel, and a clock signal, data signal, control signal, etc. are to be sequentially received by the plurality of the drive circuit devices, these signals will not be supplied to any drive circuit device on a rear stage of the drive circuit device which is currently receiving signals. Consequently, the power consumption required for supplying these signals and the generated amount of electromagnetic waves resulting from the signal supply can be suppressed, compared with the case of supplying these signals to all drive circuit devices.

In a more preferred embodiment, in the display device, a plurality of the drive circuit devices are connected in serial, and the drive circuit devices are connected to a display panel. Even if the display panel becomes larger, and the number of drive circuit devices increases, the power consumption and generated amount of electromagnetic waves can be suppressed, because propagating signals, like a clock signal, will only be supplied to the drive circuit devices, from the initial stage through the necessary stage according to the drive circuit devices as described above.

DESCRIPTION OF THE PREFERRED EMBODIMENTS

Embodiments of the present invention will now be described with reference to the drawings. It is however to be understood that the protective scope of the present invention is not limited to the embodiments shown below, but that it covers up to the invention defined by claims and its equivalents.

Figure 1:
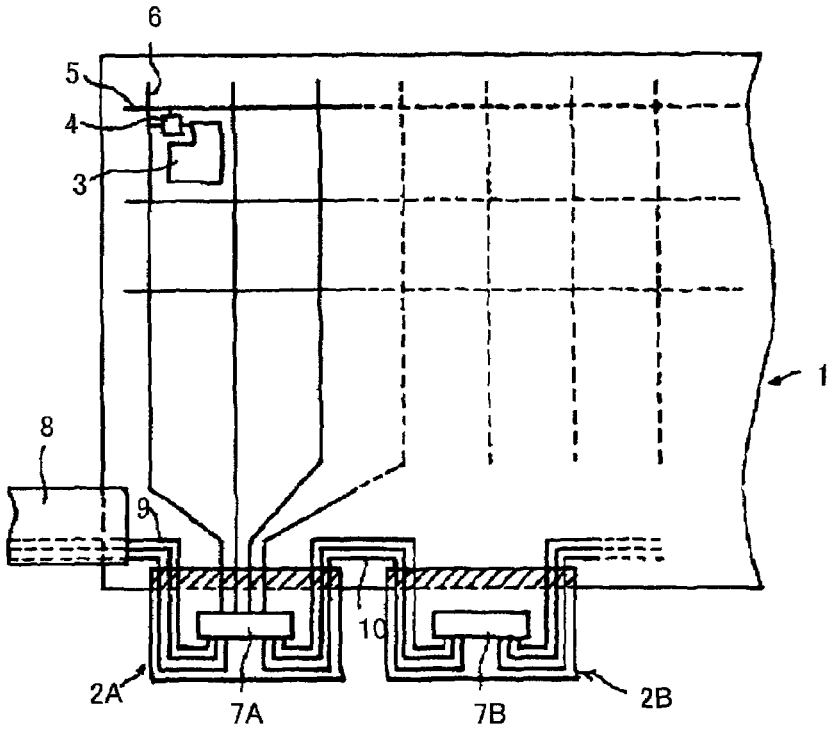
FIG. 1 shows a configuration of a liquid crystal display device in the embodiment of the present invention.

FIG. 1 shows a configuration of a liquid crystal display device in the embodiment. A display panel 1 has a TFT substrate forming TFTs, a common electrode substrate forming a common electrode, and a liquid crystal layer to be provided between them. Out of these components, a configuration of the TFT substrate is shown in FIG. 1. That is to say, on the display panel 1, pixel electrodes 3 are arranged in a matrix pattern, and corresponding to this matrix arrangement, a plurality of gate bus lines 5 and a plurality of source bus lines 6, crossing the gate bus lines, are provided, and further, TFTs 4 are provided at the intersections respectively. And, when the gate bus line 5 is driven, the TFT4 connected to the gate bus line and located in the row direction will be brought into conduction, and the voltage applied to each of the source bus lines 6 will be supplied to the pixel electrode 3. As the result of this operation, the voltage corresponding to the display data will be applied to the liquid crystal layer between the common electrode, though not noted in the drawing, and the respective pixel electrodes 3, and the liquid crystal layer can demonstrate an expected transmission factor.

To the peripheral area of the display panel 1, circuit boards 2A and 2B, mounting a drive circuit device 7A or 7B, respectively, to drive the source bus lines 6, are connected. Moreover, a printed circuit board 8 mounting an input signal supply circuit to supply a clock signal, data signal, control signal or other signals to the drive circuit devices 7A and 7B is connected to the peripheral area of the display panel 1. And, the clock signal, data signal, control signal or other signals outputted from the printed circuit board 8 are supplied to the drive circuit device circuit board 2A on the initial stage, through an input wiring 9 on the display panel 1, and further are supplied to a drive circuit device 7A on the initial stage, through wiring of the drive circuit device circuit board 2A.

Moreover, the drive circuit device 7A on the initial stage supplies the clock signal, data signal and control signal to the drive circuit device circuit board 2B on the next stage, through a connection wiring 10 on the display panel 1, and a drive circuit device 7B on the circuit board 2B receives these signals. And, the second drive circuit device 7B supplies the clock signal, data signal and control signal to drive circuit devices on the following stages, though not shown in the drawing.

As described above, the propagation signals, like the clock signal, data signal, control signal, or other signals outputted from the printed circuit board 8 of the input signal supply circuit are supplied to the plurality of the drive circuit devices 7A and 7B connected in tandem, through the connection wiring 10 on the display panel 1.

Each of the drive circuit devices 7A and 7B generates drive signals for the source bus lines, corresponding to the data signal and control signal inputted synchronizing with the clock signal. And, in the timing after all the drive circuit devices 7A and 7B sequentially input the corresponding data signal, the drive circuit devices 7A and 7B drive the corresponding source bus lines 6 simultaneously. Synchronizing with this drive, a drive circuit device on the gate side, which is not shown in the drawing, drives one of the gate bus lines 5, and the voltage applied to the respective source bus lines 6 is applied to the pixel electrodes 3 through the TFT 4.

Figure 2:
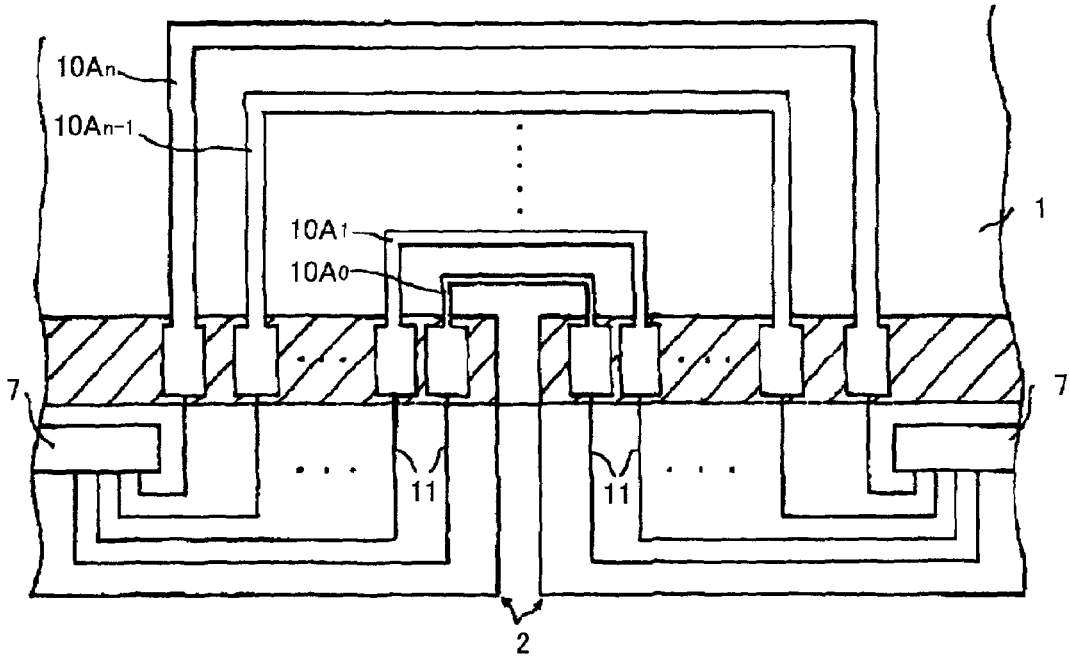
FIG. 2 shows an enlarged view of the joint section between a drive circuit device circuit board 2 and a display panel 1.

FIG. 2 shows an enlarged view of the joint section between the drive circuit device circuit board 2 and the display panel substrate 1. On the surface of the display panel 1, a connection wiring 10A is provided, and wirings 11 on the circuit board 2 mounting a drive circuit IC7 and the connection wiring 10A are connected at the joint section shown in the diagonally shaded area. The connection wirings 10A are formed so that the wiring width becomes wider and wider toward the outer side, so that delay of the signal transmittal of each wiring can be equal.

On the other hand, the plurality of gate bus lines 5 are sequentially driven by a drive circuit device on the gate side, which is not shown in the drawing, synchronizing with the timing of a horizontal synchronization signal. The drive circuit device on the gate side is also mounted on a circuit board same as shown in FIGS. 1 and 2, and the circuit board is connected to the peripheral area around the display panel 1. Moreover, a gate clock signal and control signal that should be supplied to the drive circuit device on the gate side are propagated and supplied to a plurality of gate side drive circuit device circuit boards, through connection wirings provided on the display panel 1.

Figure 3:
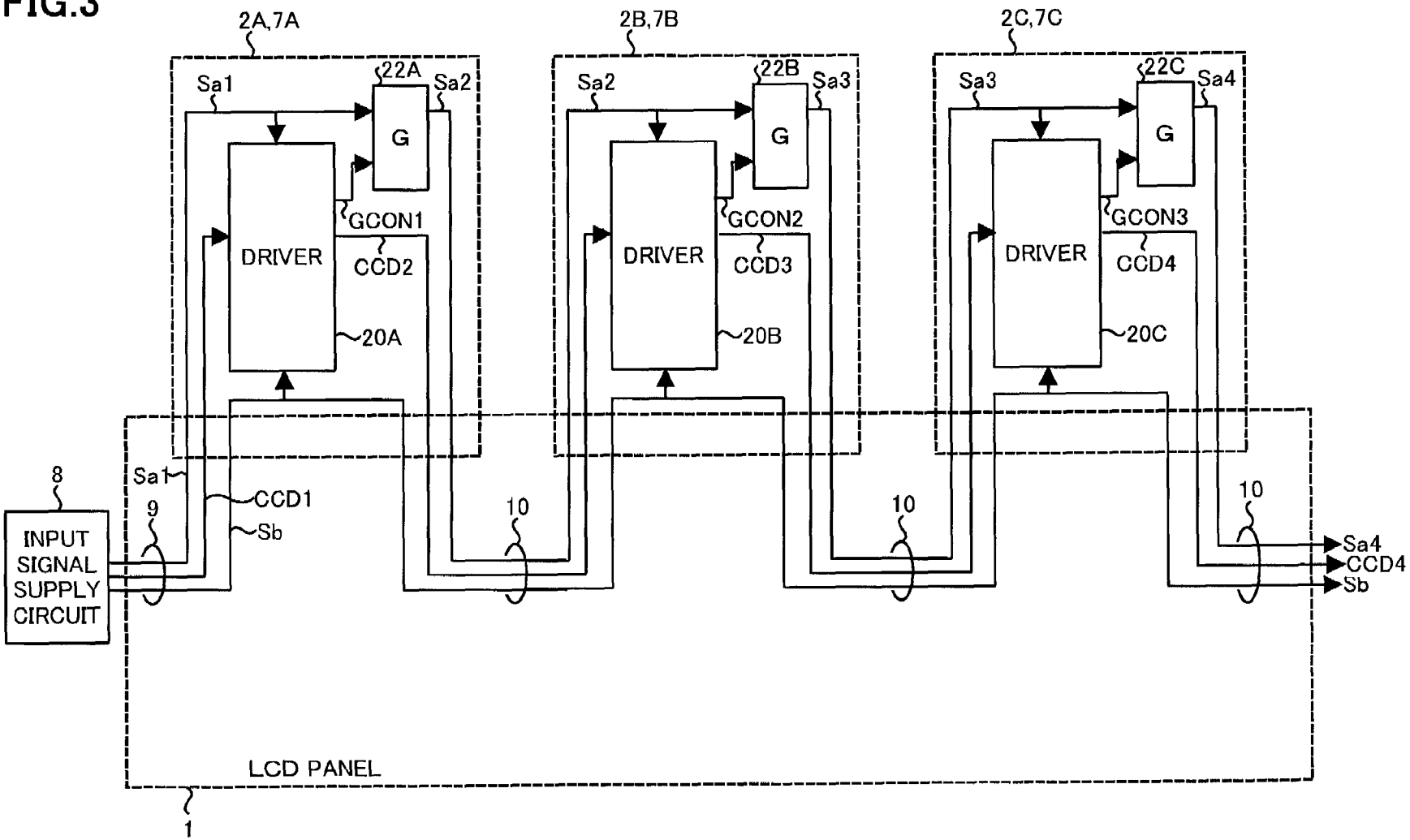
FIG. 3 shows a configuration of a drive circuit device and a display panel in the embodiment of the present invention.

FIG. 3 shows a configuration of a drive circuit device and a display panel in an embodiment of the present invention. The configuration shown in FIG. 3 can be applied to both of a source side drive circuit device and a gate side drive circuit device. As described above, to a display panel 1, like a liquid crystal panel, a drive circuit device circuit board 2 mounting a drive circuit device 7 is connected. In FIG. 3, the drive circuit device 7 and the circuit board 2 mounting the same are shown without distinguishing between them. And, three drive circuit devices 7A, 7B and 7C are connected through the connection wiring 10 on the display panel 1.

In FIG. 3, a clock signal, data signal and control signal to be supplied to the individual drive circuit device 7 are shown all together as a propagation signal Sa. This propagation signal Sa is a signal that changes during the same horizontal synchronization period (or vertical synchronization period), and is sequentially inputted to a drive circuit device 7A on an initial stage, a drive circuit device 7B on a next stage, and a drive circuit device 7C on a third stage. Also, a timing signal Sb is supplied to the plurality of the drive circuit devices 7 in parallel, and controls the specified operation timing for the plurality of the drive circuit devices 7. The timing signal Sb controls not only the operation timing, but also may control the operation itself. Further, a cascade signal CCD is a signal to control the timing when the individual drive circuit devices 7A, 7B and 7C start inputting of the propagation signal Sa, and the drive circuit device on the front stage supplies the cascade signal CCD to the drive circuit device on the rear stage to control the timing for the drive circuit device on the rear stage to start inputting.

The propagation signal Sa is inputted by the drive circuit device 7A on the initial stage, and then, inputted by the drive circuit device 7B on the next stage, and further inputted by the drive circuit device 7C on the third stage. The input start timing of the propagation signal Sa at the respective drive circuit devices 7A, 7B and 7C is controlled by the cascade signal CCD. Therefore, the propagation signal Sa is not required to be supplied to the drive circuit devices 7B and 7C on the following stages, while the drive circuit device 7A on the initial stage is inputting the signal Sa. Moreover, it is not necessary to supply the propagation signal Sa to the drive circuit devices 7C on the third stage and the following stages, while the drive circuit device 7B on the second stage is inputting the signal Sa.

Accordingly, the individual drive circuit devices 7A, 7B and 7C have driver circuits 20A, 20B and 20C to input the propagation signal Sa and drive the source bus lines or the gate bus lines, and gate circuits 22A, 22B and 22C to control the propagation of the propagation signal Sa to the rear stage. And, the gate circuits begin the propagation of the propagation signal Sa to the circuit on the rear stage, responding to gate control signals GCON 1, 2 and 3. And, the gate control signals have almost the same timing as the timing of the cascade signals CCD 2, 3 and 4 to be supplied to the drive circuit devices on the next stage, respectively, or slightly earlier timing than that. Therefore, the cascade signals CCD 2, 3 and 4 can be used instead of the gate control signals GCON 1, 2 and 3. In other words, the propagation start of the gate circuits 22A, 22B and 22C can be controlled by the cascade signals CCD 2, 3 and 4.

Therefore, to the drive circuit device 7A on the initial stage, a propagation signal Sa1 is supplied and inputted, however, the propagation of the propagation signal Sa1 to the rear stage is initially stopped by the gate circuit 22A. And at the timing when the drive circuit device 7B on the next stage starts inputting of the propagation signal, the gate circuit 22A is opened, and a propagation signal Sa2 is propagated to the drive circuit device 7B on the next stage. A propagation signal Sa3 to the drive circuit device 7C on the third stage is the same as the propagation signal Sa2.

Figure 4:
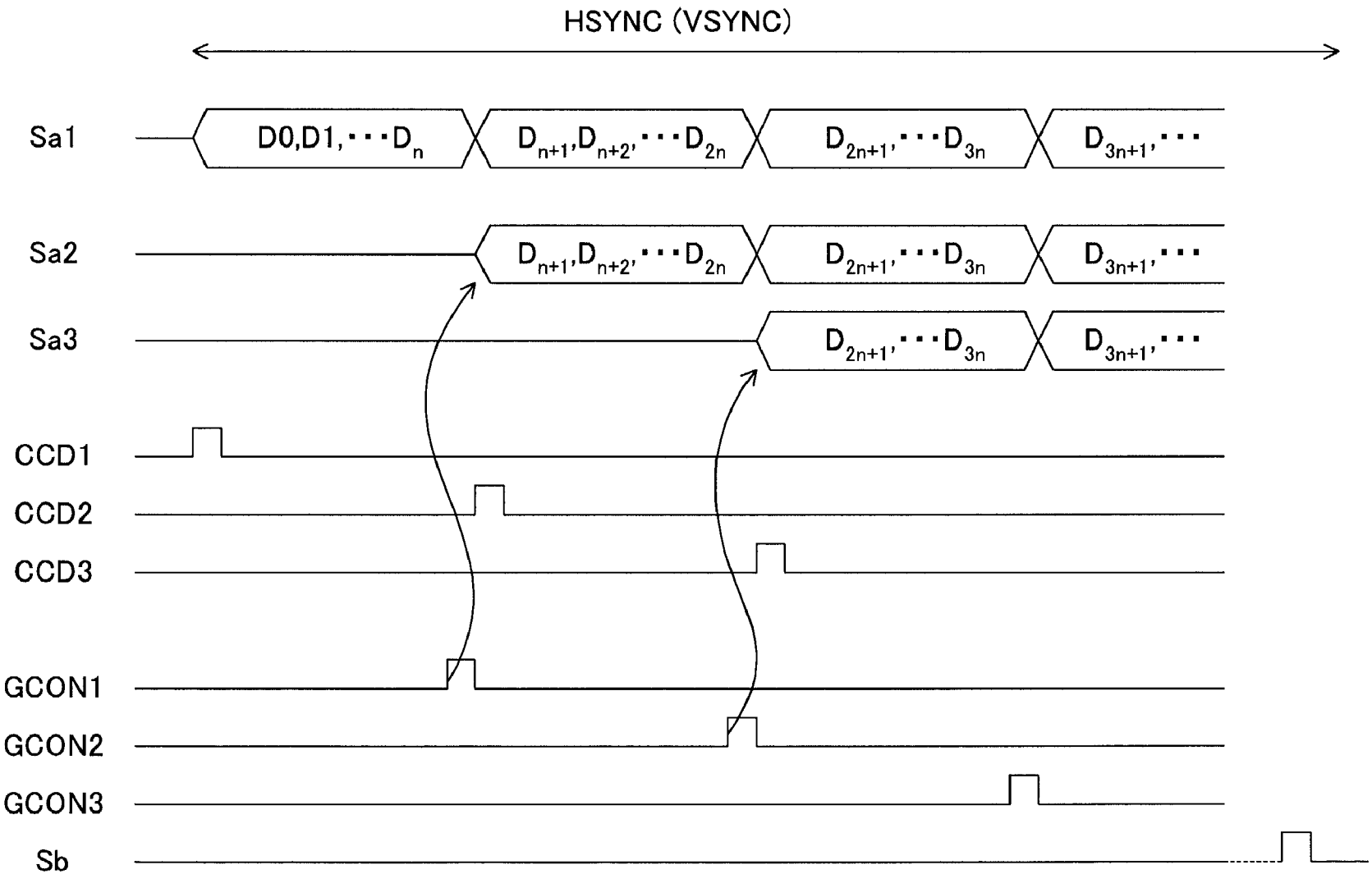
FIG. 4 is an operation-timing chart of the drive circuit device shown in FIG. 3.

FIG. 4 shows an operation-timing chart of the drive circuit device shown in FIG. 3. In FIG. 4, the propagation signal Sa, the cascade signal CCD, the gate control signal GCON, and the timing signal Sb are shown. The propagation signal Sa is sequentially inputted to the plurality of the drive circuit devices 7, during horizontal synchronization period (or vertical synchronization period), to be used for generating a drive signal. As an example of the propagation signal Sa, FIG. 4 shows that the data signals D0 through Dn, Dn+1 through D2n, and D2n+1 through D3n are individually inputted to the drive circuit devices 7A, 7B and 7C. The data signal can be a clock signal or a specified control signal.

A propagation signal Sa1 outputted from an input signal supply circuit, which is not shown in the drawing, is fetched into the driver circuit 20A, responding to a first cascade signal CCD1 to be supplied to the drive circuit device 7A on the initial stage. The propagation signal Sa1 means, as described later, a dot clock signal, data signal and its control signal, in the case of the source side drive circuit device, or a gate clock signal and its control signal in the case of the gate side drive circuit device.

While the drive circuit device 7A on the initial stage is inputting this propagation signal Sa1, the gate circuit 22A remains in the closed state, so, propagation to the drive circuit devices 7B and 7C on the rear stages will not be performed. Therefore, the propagation signal Sa1 which sequentially changes will only be propagated up to the drive circuit device 7A on the initial stage, so, the input signal supply circuit 8 will not drive the connection wiring 10 to the drive circuit devices on the rear stages.

Next, when the input of the propagation signal Sa1 by the drive circuit device 7A on the initial stage finishes, the supply of propagation signal Sa2 to the drive circuit device 7B on the next stage starts. That is to say, the gate circuit 22A opens, responding to the gate control signal GCON1 generated by the driver circuit 20A on the initial stage, and the propagation of the propagation signal Sa2 to the next stage starts. Further, responding to the cascade signal CCD2 generated by the driver circuit 20A on the initial stage, a driver circuit 20B in the drive circuit device 7B on the next stage starts inputting of the propagation signal Sa2. Therefore, the gate control signal GCON1 controls the start-up of the propagation of the propagation signal Sa to the rear stage, and the cascade signal CCD1 controls the start-up of the input of the propagation signal by the drive circuit device on the rear stage. Therefore, the gate control signal GCON1 has almost the same timing as the timing of the cascade signal CCD1, so, the gate control signal can be replaced with the cascade signal.

In FIG. 4, a timing signal Sb occurs once during the horizontal synchronization period (or vertical synchronization period), and controls the predetermined operation timing of the driver circuit.

Figure 5:
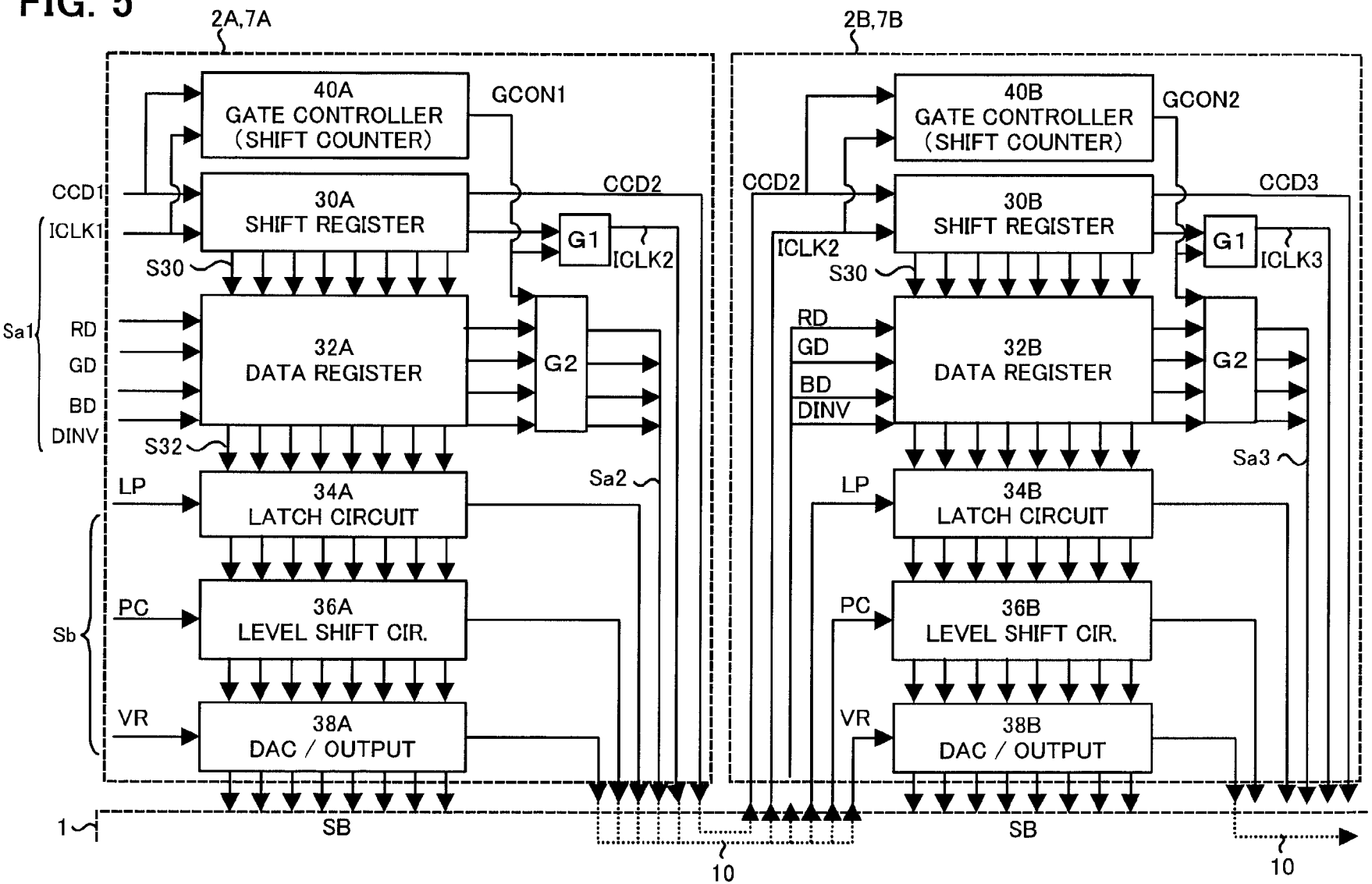
FIG. 5 shows a configuration of a source side drive circuit device.
Figure 6:
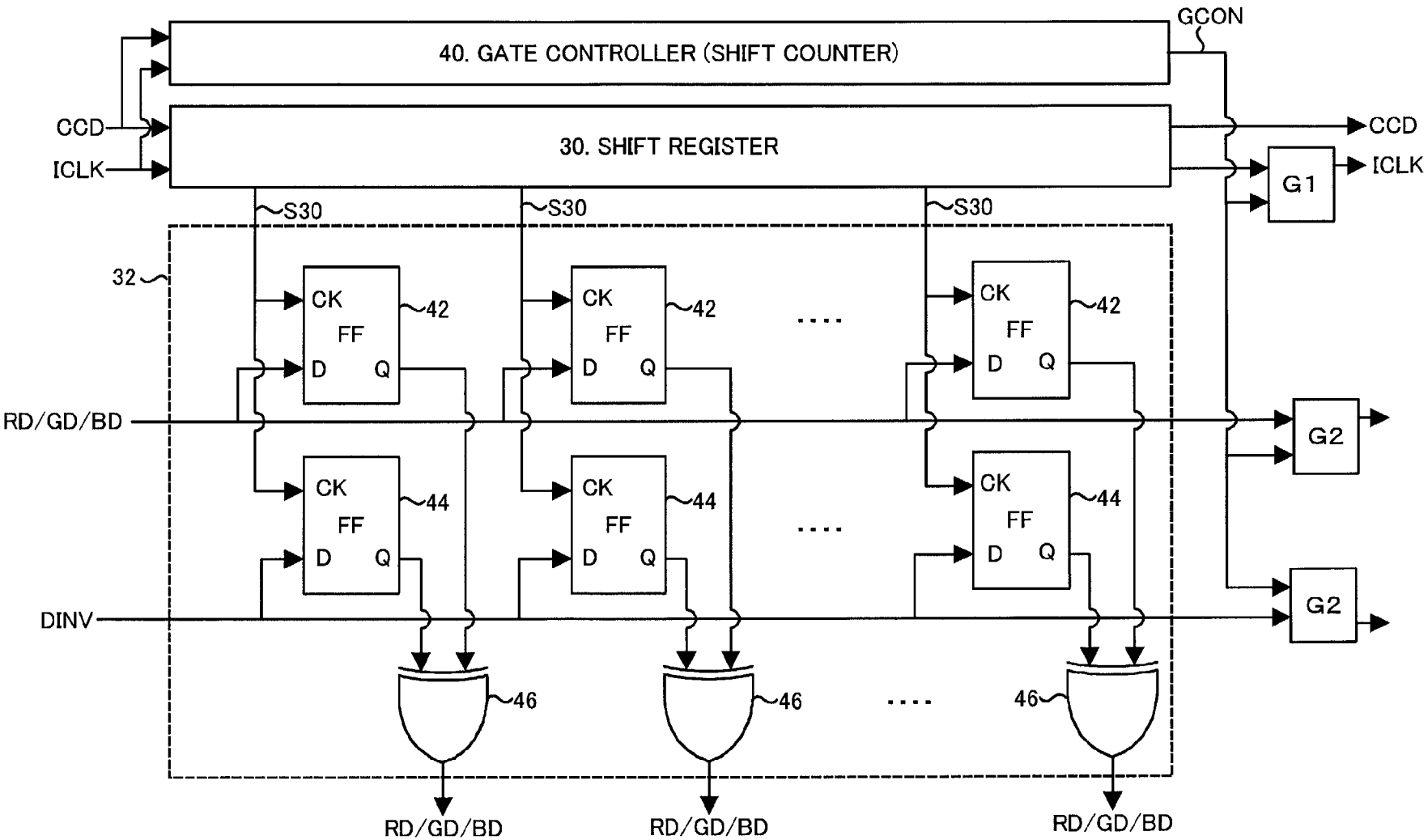
FIG. 6 shows a configuration of a data register in the source side drive circuit device.
Figure 7:
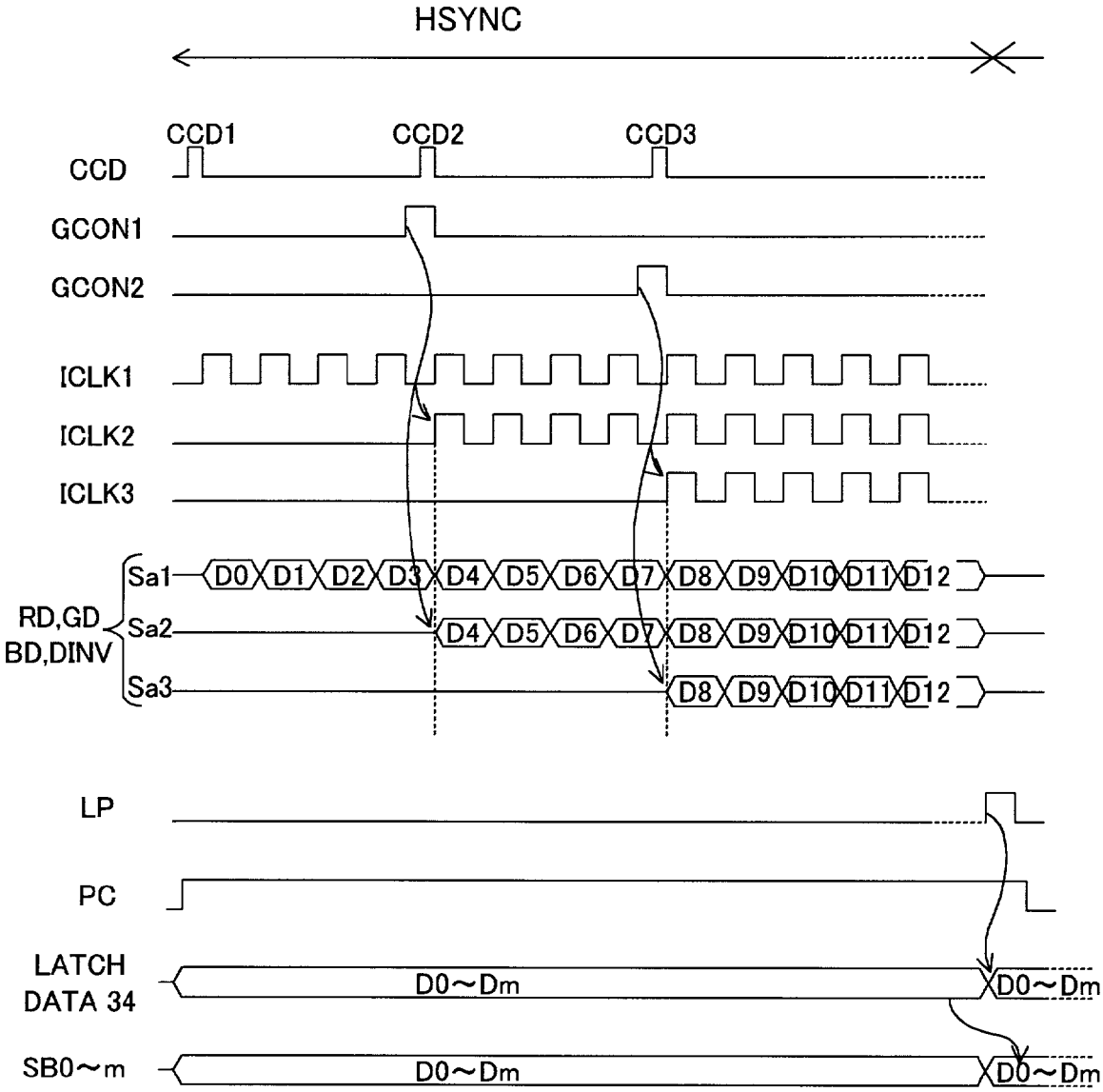
FIG. 7 is an operation-timing chart of the source side drive circuit device.

FIG. 5 shows a configuration of a source side drive circuit device. Further, FIG. 6 shows a configuration of a data register in the source side drive circuit device. And, FIG. 7 shows an operation-timing chart of the source side drive circuit device.

In FIG. 5, a drive circuit device circuit board 2A and a drive circuit device 7A on the initial stage, and a drive circuit device circuit board 2B and a drive circuit device 7B on the next stage are shown. Like FIG. 3, the drive circuit device and its mounting circuit board are shown without distinguishing between them. And, these drive circuit board circuit boards 2A and 2B are connected to a liquid crystal display panel 1.

In the case of the source side drive circuit device, as a propagation signal Sa that changes during a horizontal synchronization period, and to be inputted sequentially by individual drive circuit devices, there are a clock signal ICLK, display data signals RD, GD, BD, and their invert control signal DINV. Also, as a signal Sb to be inputted simultaneously to all drive circuit devices, there are a latch pulse LP, a phase control signal PC to control a drive polarity, and a standard voltage VR. And, to the source side drive circuit device, a cascade signal CCD to control the input start of a data signal is inputted.

The drive circuit device 7A on the initial stage has a shift register 30A, which starts inputting of a clock ICLK1 responding to a cascade signal CCD1, and shifts output signals S30 synchronizing with the clock ICLK1; a data register 32A, which inputs and holds display data signals RD, GD, BD and a data invert control signal DINV, responding to the output signal S30 of the shift register 30A; and a latch circuit 34A, which responding to a latch pulse LP, latches the data signals that are inverted or are not inverted from the display data signals RD, GD and BD inputted and held by the data register 32A, corresponding to the data invert control signal DINV.

Moreover, a drive control circuit device 7A has a level shift circuit 36A, that reverses the phases of the data signal latched by the latch circuit 34A for even numbered source bus lines and odd numbered source bus lines, corresponding to the phase control signal PC, and a D/A converter and output circuit 38A, that converts digital outputs of the level shift circuit 36A into analog outputs, and outputs the analog drive signals to the source bus lines SB.

Also, the drive control circuit device 7A has a first gate circuit G1 to propagate the clock signal ICLK1, that is the propagation signal Sa1, to the following stage, and a second gate circuit G2 to propagate the display data RD, GD, BD, and the data invert signal DINV to the following stage. A gate control signal GCON1 to control the gate circuits is generated by a gate control circuit 40A. The gate control circuit 40A inputs and shifts the clock ICLK1, responding to the cascade signal CCD1, and generates the gate control signal GCON1, in the timing when a drive circuit device on the next stage starts inputting the propagation signal Sa2. The first and the second gate circuits G1 and G2 open, responding to the gate control signal GCON1, and start propagating of the propagation signal Sa2 and the clock ICLK2 to the drive circuit device on the next stage.

Like the drive circuit device 7A, a drive circuit device 7B on the next stage has a shift register 30B, a data register 32B, a latch circuit 34B, a level circuit 36B, a D/A converter/output circuit 38B, a gate control circuit 40B, and further a first and a second gate circuits G1 and G2. And, the drive circuit device 7A on the initial stage and the drive circuit device 7B on the next stage are connected through connection wirings 10 on a display panel 1.

As shown in FIG. 6, the data register 32 has first flip-flops 42 to sequentially latch display data signals RD, GD and BD, synchronizing with shift outputs S30 to be sequentially outputted from the shift register 30, synchronizing with the clock ICLK, second flip-flops 44 to sequentially latch a data invert control signal DINV, and EOR gates 46 to output an XOR (an exclusive OR) of the data invert control signal and the display data. Each of the display data signals RD, GD and BD is a digital signal of 8 bits; therefore, the first flip-flops 42 latch digital signals of 24 bits. Also, the data invert control signal DINV is a control signal of 1 bit to be supplied, corresponding to the 24 bits display data signals.

With the display data signals RD, GD and BD being digital signals of 24 bits, 24 signal lines must be driven to H, L levels, synchronizing with the clock ICLK. So, information on whether the supplied display data signals RD, GD and BD of 24 bits should be inverted or not, comparing the display data signal of the previous pixel and the display data signal of the next pixel, will be generated as the data invert control signal DINV. By the utilization of the data invert control signal DINV, the number of bits of the display data signals which change from H level to L level, or from L level to H level can be reduced to less than a half of 24 bits.

For instance, in case of displaying data in white for the previous pixel, corresponding to the highest tone level, the display data signal of 24 bits is all H level, and if the pixel next to that is for display in black, corresponding to the lowest tone level, the display data signal of 24 bits is all L level. Consequently, the display data signals of 24 bits must change from the H level to the L level simultaneously. Therefore, by driving only the data invert control signal DINV to the H level to show inversion of display data signals, leaving all the display data signal on H level without changing, the power to drive the display data signal lines can be suppressed.

By the EOR gate 46, the latched display data signals are inverted by the data invert control signal DINV of H level that indicates invert, and the latched display data signals are not inverted by the data invert control signal DINV of L level that indicates non-invert.

Then, the following shows description of operation of the source side drive circuit device, with reference to the operation-timing chart shown in FIG. 7. The drive circuit device 7A on the initial stage inputs the clock ICLK1, responding to the cascade signal CCD1, and the shift register 30A sequentially generates the data latch signals S30, synchronizing with the clock. Further, the display data signals RD, GD and BD, and their invert control signal DINV (the propagation signal Sa1 as noted in FIG. 7) change, synchronizing with the clock ICLK1, and the data register 32A inputs and holds these display data signals and the invert control signal, responding to the data latch signals S30.

During that processing, the gate control circuit 40A counts the clock ICLK responding to the cascade signal CCD1, and generates a gate control signal GCON1, aligning with the timing when the drive circuit device 7B on the next stage starts inputting the display data signals and their invert control signal.

Responding to this gate control signal GCON1, the first and the second gate circuits G1 and G2 start sequential transferring of the clock signal ICLK2, the display data signals RD, GD, BD, and the data invert control signal DINV to the rear stage. The gate circuits G1 and G2, which comprise, for instance, a non-invert buffer circuit, a transfer circuit, etc., start propagating of signals to the rear stage, responding to the gate control signal GCON1. Therefore, as shown in FIG. 7, a second propagation signal Sa2 starts changing, responding to the gate control signal GCON1. Further, a second clock signal ICLK2 also starts changing, responding to the gate control signal GCON1.

Responding to a cascade signal CCD2 outputted from a shift register 30A on the initial stage, a shift register 30B in a drive circuit device 7B on a second stage starts inputting of the clock ICLK2, and sequentially outputs data latch signals S30, synchronizing with the clock. Responding to the output, a data register 32B inputs and holds the display data signals RD, GD, BD, and the data invert control signal DINV, that are the second propagation signal Sa2.

When the drive circuit device 7B on the second stage almost finishes the input of the display data signals and the data invert control signal, a gate control circuit 40B outputs a second gate control signal GCON2, aligning with the timing when a drive circuit device on the third stage, which is not shown in the drawing, starts input. With this output, transfer of a clock signal ICLK3, display data signals RD, GD, BD, and the data invert control signal DINV to a drive circuit device on the third stage starts.

When the input of the display data signals and the data invert control signal finished at all drive circuit devices, a latch pulse signal LP is generated, and latch circuits 34 in all drive circuit devices latch display data D0 through Dm held in the data registers 32. Simultaneously with the latch, the display data D0 through Dm held by the latch circuits 34 are transferred to level shift circuits 36.

The level shift circuit 36 changes the polarity of the display data to the odd side source bus lines into negative or positive, and the polarity of the display data to the even side source bus lines into negative or positive, corresponding to a phase control signal PC, and outputs to a digital/analog convert circuit and output circuit 38. Then, the source bus lines SB0 through SBm will be driven simultaneously.

As described above, while a source drive circuit device on the initial stage is inputting the display data signal, data invert signal and the clock signal, transfer of these signals to a source drive device on the next stage is stopped, for the purpose of suppressing power consumption and occurrence of electromagnetic wave caused by changes in these signals. And, in the timing when a source drive circuit device on the second stage starts inputting of the display data signal, data invert signal and the clock signal, the gate circuit opens, so that propagation of these propagation signals to source drive circuit devices on the second can be started. However, at this time, propagation of these propagation signals to source drive circuit devices on the third stages or following stages is left in the stopped state.

As described above, the propagation signals are propagated only to the least possible number of drive circuit devices, and the propagation of the propagation signals to drive circuit devices on the following stages is stopped, so that power consumption and occurrence of electromagnetic wave can be suppressed.

Figure 8:
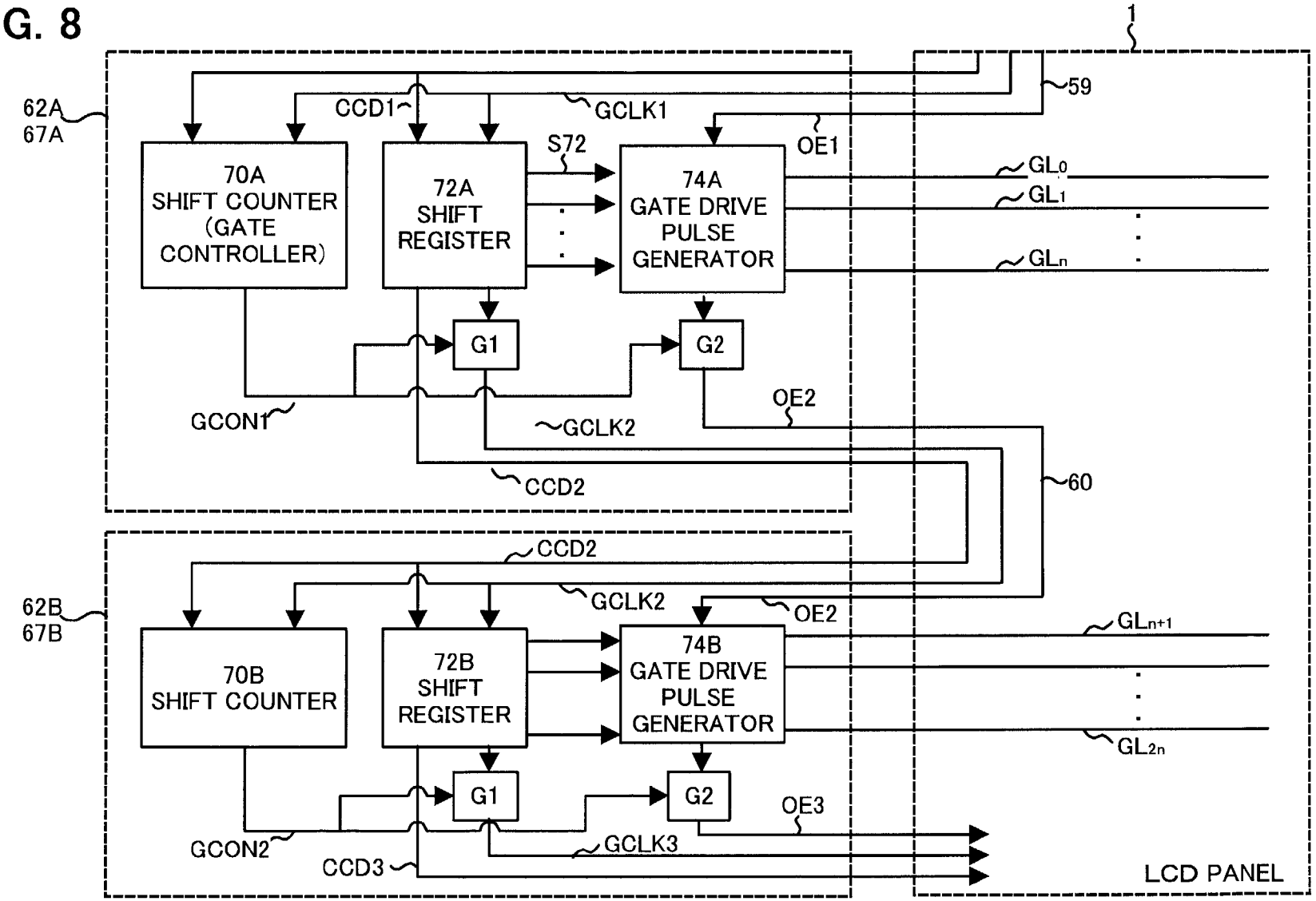
FIG. 8 shows a configuration of a gate side drive circuit device.
Figure 9:
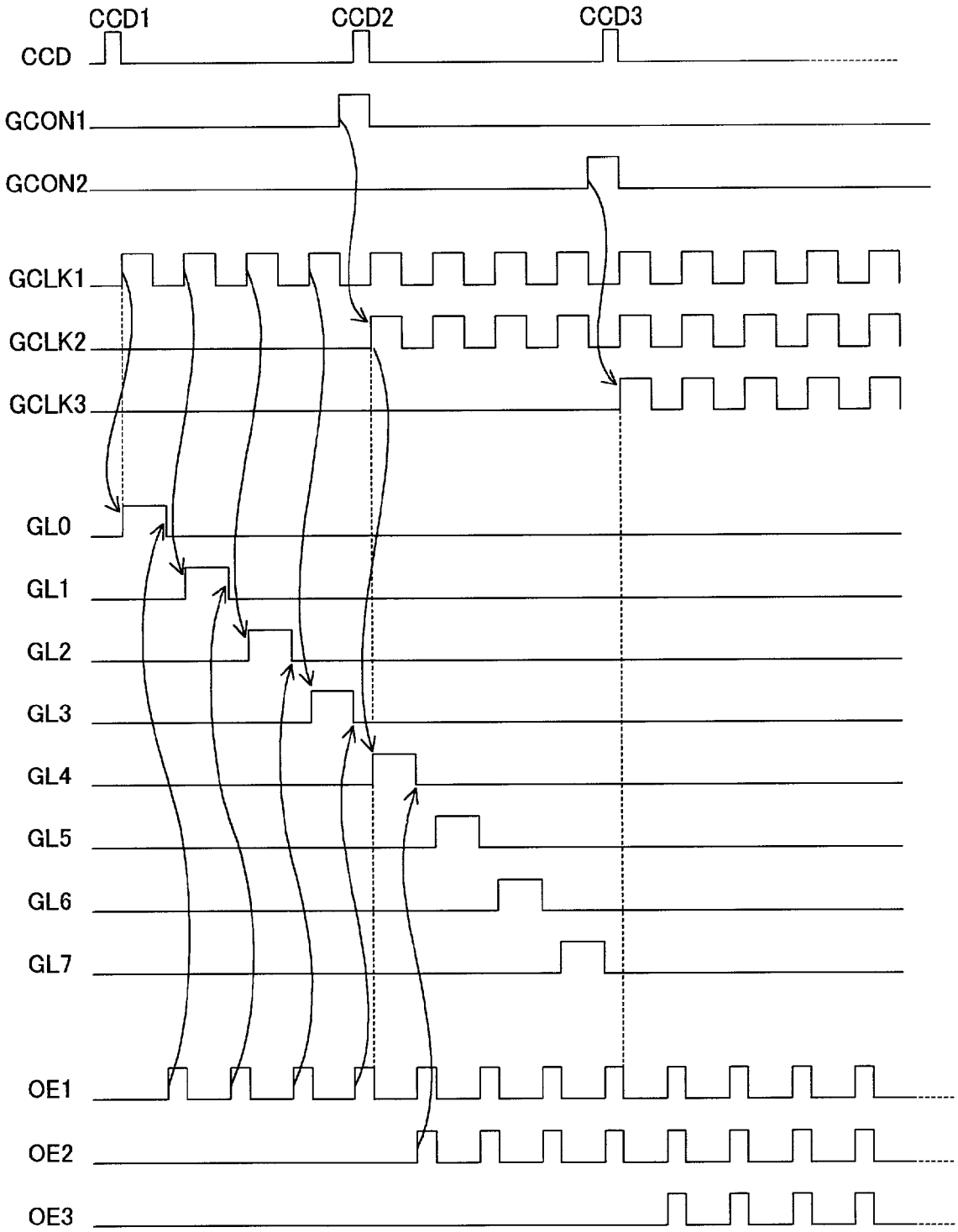
FIG. 9 is an operation flowchart of the gate side drive circuit device.

FIG. 8 shows a configuration of a gate side drive circuit device. And FIG. 9 shows its operation flowchart. The gate side drive circuit devices 67A and 67B are individually mounted on drive circuit device circuit boards 62A and 62B, and connected to a liquid crystal display panel 1. Also, the devices 67A and 67B, and the circuit boards 62A and 62B are shown in FIG. 8, without distinguishing each other. And, the gate side drive circuit device 67A on the initial stage and the gate side drive circuit device 67B on the next stage are connected through connection wirings 60 on the display circuit panel 1.

The gate side drive circuit devices 67A and 67B sequentially drive gate bus lines GL0 through GLn and GLn+1 through GL2N provided on the display panel 1, synchronizing with a gate clock GCLK. For this purpose, the gate side drive circuit device has shift registers 72A and 72B to input a gate clock GCLK, and sequentially generate a drive timing signal S72 synchronizing with the input; and gate drive pulse generator circuits 74A and 74B to sequentially generate gate drive pulse signals, synchronizing with the drive timing signal S72. Output enable signals 0E1 and 0E2 to be supplied to the gate drive pulse generator circuits 74A and 74B are signals to control the drive pulse timing for the purpose of preventing the gate bus lines from becoming the double selection state caused by the overlapping drive pulses to the adjacent gate bus lines.

Moreover, the gate drive circuit devices 67A and 67B have gate circuits G1 and G2 to control the propagation of the gate clock GCLK and the output enable signal OE to the rear stage. Shift counters 70A and 70B generate the gate control signals GCON1 and 2 aligning with the timing when a drive circuit device on the rear stage starts input, and these gate circuits G1 and G2 start the transfer of the gate clock and output enable signal to the rear stage, responding to the gate control signals. The operations of the gate circuit and the shift counter (gate control circuit) are the same as those on the source side drive circuit device.

Next, the following describes operations with reference to FIG. 9. From an input circuit device, which is not shown in FIG. 8, through input wirings 59 on the display panel 1, the gate clock signal GCLK1, the output enable signal OE1, and the cascade signal CCD1 are supplied to the drive circuit device 67A on the initial stage. The shift register 72A starts the input of the gate clock GCLK1, responding to the cascade signal CCD1, and sequentially generates gate drive timing signals S72, and further, the gate drive pulse generator circuit 74A sequentially generates gate drive pulses GL0 and so on. The gate drive pulses GL0 and so on generated by the gate drive pulse generator circuit 74A rise in the timing of the drive timing signal S72, and fall in the timing of the output enable signal OE1.

When the gate side drive circuit device 67A on the initial stage finishes driving of the corresponding gate bus lines, the gate control signal GCON1 is generated in the timing when the gate side drive circuit device 67B on the next stage starts inputting of the gate clock signal GCLK2 and the output enable signal OE2, so that the gate circuits G1 and G2 start the transfer of the gate clock signal and the output enable signal to the rear stage. Therefore, responding to the gate control signal GCON1, the propagation of a second gate clock signal GCLK2 and a second output enable signal OE2 starts.

The gate side drive circuit device 67B on the next stage starts inputting of the second gate clock signal GCLK2 and the second output enable signal OE2, and sequentially drives the corresponding gate bus lines GL. And, the gate side drive circuit device 67B on the next stage also opens the gate circuits G1 and G2, aligning with the timing when the gate side drive circuit device on the rear stage (not noted in the drawing) starts inputting of the gate clock signal and the output enable signal, and starts the propagation of a third gate clock signal GCLK3 and a third output enable signal OE3.

Therefore, the propagation signals, like the gate clock signal GCLK and the output enable signal OE are only propagated up to the drive circuit device that inputs these signals and drives the gate bus lines, and the propagation to drive circuit devices on the following stages will not be performed. Therefore, power consumption associated with driving these signals and occurrence of electromagnetic wave can be suppressed.

As described above, in the embodiments of the present invention, the supply of the clock signal, data signals, control signals, etc. to a plurality of drive circuit devices is limited only to the stage that inputs these signals and performs the predetermined operation, and the supply of these signals is stopped to drive circuit devices on the following stages. Therefore, even if drive load becomes larger, caused by the signal wiring to supply these signals becoming longer, or the signal wiring formed on the display panel increases the resistance or capacitance, the signal wiring to be driven can be suppressed, so that power consumption and occurrence of electromagnetic wave can be suppressed.

In the embodiment as described above, in the source side drive circuit device, the timing of starting the propagation of all of the clock signal, data signals and data invert signal to the rear stage has been controlled by the gate circuit, but the timing of starting the propagation of at least one of the clock signal, data signals and data invert signal to the rear stage may be controlled. Also, in the gate side drive circuit device, the timing of starting the propagation of at least one of the gate clock signal and output enable signal to the rear stage may be controlled.

As set forth hereinabove, according to the present invention, by means of allowing the propagation signals propagating to a plurality of drive circuit devices, not to be propagated to drive circuit devices in the rear stages following the drive circuit device that inputs the propagation signal, power consumption accompanied with driving of the propagation signal and occurrence of electromagnetic wave can be suppressed. Therefore, the drive circuit device of the present invention is useful as a drive circuit device for the display device such as the liquid crystal display device.

What is claimed is:

1. A drive circuit device for a display device which drives a part of a plurality of bus lines disposed on a display panel and is connectable to a rear-stage drive circuit device via propagation signal line, the drive circuit device comprising: a driver unit that receives a propagation signal including at least one of a clock signal and a control signal, and generates a drive signal for the bus lines according to the received propagation signal, said propagation signal changing during a synchronization period in synchronization with a synchronization signal; and a gate unit that, at the timing when the rear-stage drive circuit device starts receiving the propagation signal, after elapse of predetermined time from the reception of the propagation signal by the driver unit, starts outputting of the propagation signal to the rear-stage drive circuit device via the propagation signal line, and that does not output the received propagation signal during the predetermined time to the rear-stage drive circuit device via the propagation signal line so as to suppress magnetic wave at the propagation signal line, where in the rear-stage drive circuit device generates a drive signal for the rear-stage bus lines according to the received propagation signal.

2. A drive circuit device for a display device which drives a part of a plurality of source bus lines disposed on a display panel and is connectable to a rear-stage drive circuit device via propagation signal line, the drive circuit device comprising: a driver unit that receives a clock signal, a data signal and a control signal, and sequentially fetches the data signal to generate a drive signal for the source bus lines in accordance to the fetched data signal; and a gate unit that does not output a propagation signal, including at least one of the clock signal, data signal and control signal, to the rear-stage drive circuit device during the sequential fetching of the data signal by the driver unit, and starts outputting of the propagation signal to the rear-stage drive circuit device at the timing when the rear-stage drive circuit device starts receiving the propagation signal via the propagation signal line so as to suppress magnetic wave at the propagation signal line, after the sequential fetching, where in the rear stage drive circuit device generates a drive signal for the rear-stage bus lines according to the received propagation signal, and wherein said propagation signal changes during a synchronization period in synchronizing with a synchronization signal.

3. The drive circuit device according to claim 2, wherein the control signal includes an invert control signal indicative of "invert", or "non-invert" of the data signal.

4. The drive circuit device according to claim 2, wherein the driver device receives an input cascade signal to control the start of fetch of the data signal, and outputs an output cascade signal to control the fetch of the data signal at the rear stage, after the completion of fetching of the data signal.

5. The drive circuit device according to claim 4, further comprising:

a gate control circuit that inputs the input cascade signal and clock signal, and generates a gate control signal to control the gate unit to start outputting of the propagation signal.

6. The drive circuit according to claim 4, wherein the gate unit starts outputting of the propagation signal, in response to the output cascade signal.

7. The drive circuit device according to claim 4, further comprising a data register to fetch and hold the data signal at the timing of the clock signal, in response to the input cascade signal.

8. A drive circuit device for a display device which sequentially drives a part of a plurality of gate bus lines disposed on a display panel and is connectable to a rear-stage drive circuit device via propagation signal line, the drive circuit device comprising: a driver unit that receives a clock signal and a control signal, and sequentially generates drive signals for the gate bus lines, in synchronism with the clock signal; and a gate unit that does not output the propagation signal to the rear-stage drive circuit unit via the propagation signal line so as to suppress magnetic wave at the propagation signal line, wherein said propagation signal changes during a synchronization period in synchronizing with a synchronization signal, and where in the rear stage drive circuit device generates a drive signal for the rear-stage bus lines according to the received propagation signal.

9. The drive circuit device according to claim 8, wherein the control signal includes an output enable signal to control the outputting period of the drive signal generated by the driver unit.

10. The drive circuit device according to claim 8, wherein the drive circuit device receives an input cascade signal to control the start of fetching of the clock signal, and outputs an output cascade signal to control the fetching of the clock signal at the rear stage, after the completion of generation of the drive signals for the gate bus lines.

11. The drive circuit device according to claim 10, further comprising a gate control circuit which inputs the input cascade signal and the clock signal, and generates a gate control signal to control the gate unit to start outputting of the propagation signal.

12. The drive circuit device according to claim 10, wherein the gate unit starts outputting of the propagation signal, in response to the output cascade signal.

13. The drive circuit device according to claim 10, further comprising a gate drive signal generator circuit to generate the drive signals at the timing of the clock signal, in response to the input cascade signal.

14. A display device having a plurality of drive circuit devices according to any one of claims 1, 2, or 8 that are connected in tandem, the display device further comprising a display panel to which the plurality of drive circuit devices are connected, the display panel being provided with a plurality of source bus lines and a plurality of gate bus lines that intersect the source bus lines.

15. A display device comprising: a display panel having a plurality of source buses, a plurality of gate buses cross-connecting to the source buses, and a plurality of pixels at cross-connecting positions thereof; and a plurality of drive circuit units, provided to the display panel, for driving of the gate buses or the sources buses, wherein each of said plurality of drive circuit units includes: a driver unit that receives a propagation signal including at least one of a clock signal and a control signal, and generates a drive signal for the gate buses according to the received propagation signal, said propagation signal changing during a synchronization period in syndhronization with a synchronization signal; and a gate unit that does not output the propagation signal received during a predetermined time from the reception of the propagation signal by the driver unit to the rear-stage drive circuit unit via the propagation signal line connected to the rear-stage drive circuit unit, and starts outputting of the propagation signal to the rear-stage drive circuit unit at the timing when the rear-stage drive circuit unit starts receiving the propagation signal after elapse of the predetermined time via the propagation signal line so as to suppress magnetic wave at the propagation signal line, where in the rear-stage drive circuit device generates a drive signal for the rear-stage bus lines according to the received propagation signal.

16. A display device comprising: a display panel having a plurality of source buses, a plurality of gate buses cross-connecting to the source buses, and a plurality of pixels at cross-connecting positions thereof; and a plurality of drive circuits units provided to the display panel, for driving a part of the source buses, wherein each of said plurality of drive circuit units includes: a driver unit that receives a clock signal, a data signal and a control signal, the data signal being sequentially changed for each source bus, and sequentially fetches the data signal to generate a drive signal for the source bus in accordance to the fetched data signal; and a gate unit that does not output a propagation signal including at least one of the clock signal, data signal and control signal to the rear-stage drive circuit unit during the sequential fetching of the data signal by the driver unit, and starts outputting of the propagation signal to the rear-stage drive circuit unit after the sequential fetching via a propagation signal line connected to the rear-stage drive unit so as to suppress magnetic wave at the propagation signal line, wherein said propagation signal changes during a synchronization period in synchronizing with a synchronization signal, and where in the rear stage drive circuit device generates a drive signal for the rear-stage bus lines according to the received propagation signal.

17. A display device comprising: a display panel having a plurality of source buses, a plurality of gate buses cross-connecting to the source buses, and a plurality of pixels at cross-connecting positions thereof; and a plurality of drive circuit units, provided to the display panel, for driving apart of the gate buses, wherein each of said plurality of drive circuit units includes a driver unit that receives a clock signal and a control signal, and sequentially generates drive signals for the gate bus lines, in synchronism with the clock signal; and a gate unit that does not output the propagation signal to the rear-stage drive circuit device during the generation of the drive signals by the driver unit, and starts outputting of the propagation signal to a rear-stage drive circuit unit via a propagation signal line connected to the rear-stage drive unit so as to suppress magnetic wave at the propagation signal line, wherein said propagation signal changes during a synchronization period in synchronizing with a synchronization signal, and where in the rear stage drive circuit device generates a drive signal for the rear-stage bus lines according to the received propagation signal.

* * * * *